United States Patent [19]

Egerer

[11] 4,266,327

[45] May 12, 1981

[54] RELEASABLY INTERLOCKING NEEDLESTRIP AND NEEDLE-CARRIER FOR TEXTILE MACHINES

[75] Inventor: Josef Egerer, Schwabach, Fed. Rep. of Germany

[73] Assignee: Staedtler & Uhl, Schwabach, Fed. Rep. of Germany

[21] Appl. No.: 119,611

[22] Filed: Feb. 8, 1980

[30] Foreign Application Priority Data

Mar. 10, 1979 [DE] Fed. Rep. of Germany ..... 2909525

[51] Int. Cl.[3] ..... D06C 3/10; D01H 5/14; D01G 19/10

[52] U.S. Cl. ..... 28/299; 19/129 R; 26/96

[58] Field of Search ..... 19/129 R; 26/96; 28/212, 299; 66/114

[56] References Cited

U.S. PATENT DOCUMENTS 3,066,378 12/1962 Mohring ..... 26/96
3,156,951 11/1964 Herubel ..... 19/129 R

FOREIGN PATENT DOCUMENTS 1126703 7/1956 France ..... 19/129 R

*Primary Examiner*—Robert Mackey
*Attorney, Agent, or Firm*—Jordan and Hamburg

[57] ABSTRACT

A releasably interlockable needlestrip and needle-carrier for textile machines includes a generally U-shaped elongated needle carrier having legs defining a longitudinally extending recess therebetween. A plurality of protuberances are provided on one of the legs projecting into the recess. A bracket member is positionable in abutting relationship with a needlestrip and one of the legs thereof is positionable in abutting relationship with the top face of the needlestrip, the needlestrip and bracket member when positioned in such abutting relationship being dimensioned and configured to fit within the recess of the needle carrier. A plurality of slots are formed in the surface of one leg of the bracket member with each slot having a first vertically extending segment and a second longitudinally extending segment, the protuberances and slots being so configured and arranged on the needle-carrier and bracket member that upon insertion of the needlestrip and bracket member into the recess of the needle-carrier, the protuberances are alignable with the segments of corresponding slots and are slidable therein for mechanical and releasable interlocking of the needlestrip, bracket member and needle-carrier.

10 Claims, 3 Drawing Figures

RELEASABLY INTERLOCKING NEEDLESTRIP AND NEEDLE-CARRIER FOR TEXTILE MACHINES

BACKGROUND OF THE INVENTION

This invention relates to needlestrips and interlocking needle-carriers, the needlestrips and needle-carriers having cooperable protuberances and slots, such structures being used in needle-carrying textile machines.

Interlocking needlestrips and needle-carriers are disclosed in applicant's German Patent Application No. P 29 06 544.9 and are useful, for example, with textile machines, such as tenterframes, combing machines, heckles, fiber processing machines, perforating machines, expanders and the like. The mechanical interlocking of such needlestrip and needle-carrier must be secure and should be adequate to satisfy the static demands of such a machine. The replacement of needlestrips should be sufficiently simple such that a minimum of time is needed for such an operation and the expense of such replacement is reduced as much as possible.

According to the invention of applicant's aforesaid German patent application, protuberances arranged on one element are cooperable with corresponding slots in another element, and a secure interconnection is obtained when the protuberances are shifted into the terminal portions of the slots. In such application, the proturberances are usually provided upon the needlestrip and the slots are formed in the needle-carrier at the machine side; however, it was contemplated also that a reverse construction was possible. According to the present invention, the protuberances are provided on the needle-carrier and slots are on arranged on an angular bracket which is positioned so as to abut the needlestrip on at least one side thereof and also at the frontal face or surface carrying the needles. The bracket is configured and dimensioned to be introduced in the needle-carrier together with the needlestrip. Although, as compared with the construction of applicant's cited application, an additional component in the form of a bracket is required, construction of the needlestrips themselves is simplified since it is unnecessary to form either protuberances or slots therein. Rather, the angular bracket is anchored in the U-inner space or recess of the needlestrip which is no different from needlestrips on any other machine. It suffices to have the bracket at least partly overlap the frontal face of the needlestrip at least so far that the needlestrip is held securely. This is of particular importance when the needles are mounted with very small distances therebetween.

In its simplest form, an L-shaped bracket is employed. However, in another embodiment a bracket is used which has a U-shaped cross section so that its web element abuts one side of the needlestrip and its opposed legs abut the respective opposite frontal faces or surfaces of the needlestrip. This U-shaped bracket accepts in its recess the needlestrip so that the needles mounted therein project from one frontal face. For this purpose, the leg of the bracket which abuts the face of the needlestrip from which the needles project is provided with apertures to accommodate passage of the needle stems therethrough. According to another alternative, they may consist of arcuate recesses which are open towards the free end of the bracket leg.

Another alternative of the invention provides for locking pins arranged upon the leg of the bracket which abuts the frontal face of the needlestrip comprising its base. These locking pins can be releasably locked within apertures in the transverse connecting section or bight of the U-shaped needle-carrier. Such interconnection supplements the cooperable action between the proturbances and slots and thereby additionally increases the security of the connection between the needlestrip and needle-carrier without making replacement of the needlestrips difficult.

These apertures in the needle-carrier may comprise an enlarged section for reception of an enlarged head of the locking pins and a longitudinally extending slot-like opening for reception of the stem of the locking pin. A wedging action between the locking pins and corresponding apertures results in tightening of the connection upon longitudinal movement.

It is furthermore within the ambit of the invention to provide the protuberances in the form of pins which are set into boreholes in one leg of the needle-carrier which pins protrude by their tips into the inner space or recess of the needle-carrier. This step greatly simplifies manufacture of the device.

Additional objects and advantages of the invention will become readily apparent from the ensuing description.

BRIEF DESCRIPTION OF THE DRAWINGS

In order that the invention may be more fully comprehended, it will now be described, by way of example, with reference to the accompanying drawings in which.

DESCRIPTION OF THE PREFERRED EMBODIMENTS

Figure 1:
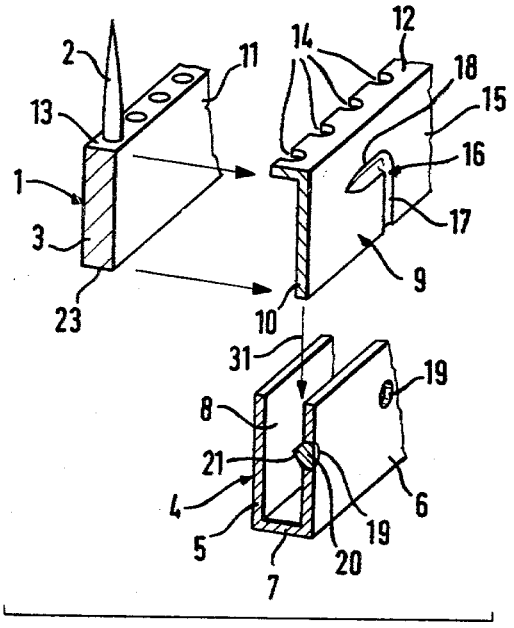
FIG. 1 is a fragmentary perspective view of a needlestrip and needle-carrier embodying the features of the invention before assembly.

Referring to FIG. 1 of the drawings, there is shown generally schematically a needlestrip 1 which carries therein a plurality of needles 2 which are speced longitudinally at more or less large but equal distances from each other. The needle stems are fastened to or mounted in the body 3 of the needlestrip 1, for example, by soldering, glueing or the like. Once the needles 2 have become either worn or broken, the needlestrips 1 are replaced. During such replacement it is desirable to reduce the down time of the machine as much as possible.

Needle-carriers 4 are provided on the machine and have a U-shaped cross section which includes legs 5 and 6 and transversely extending crossbar or bight section 7. The inner space or recess 8 of each needle-carrier 4 serves for the reception and securement of one needlestrip 1. In order to effectuate such securement bracket 9 is provided which is according to the embodiment shown in FIG. 1, an angle member consisting of legs 10 and 12. The leg 10 is designed to abut one face 11 of the needlestrip 1. Leg 12, which is shorter than leg 10 and angularly offset therefrom, overlaps the frontal face or surface 13 of the needlestrip 1 from which the needles 2 project. As can be seen most clearly from FIG. 1, leg 12 is provided with a series of recesses 14, open at one side, each of such recesses being adapted to accept one needle 2. These recesses 14 may, alternatively constitute boreholes disposed in leg 12. In such event, the bracket 9 is positioned on the needlestrip from above to accommodate the tips of the needles 2 when the bracket is to be assembled to the needlestrip. On the other hand, in the embodiment shown in FIG. 1 the bracket 9 may be shifted laterally into combination with the needlestrip 1.

Slots 16 are formed at equal distances and parallel to each other in the outer plane or surface 15 of the leg 10 of bracket 9. The slots 16 each consist of a vertically extending segment 17 and an end-segment 18 which extends approximately parallel to the longitudinally extending crossbar or bight section 7. The transition between the segments 17 and 18 of slot 16 may be arcuate or angular, preferably obtuse.

Boreholes 19 are provided in leg 6 of the needle-carrier 4 at distances corresponding to the distances between the vertical segments 17 of slots 6. In each borehole 19, a pin 20 is inserted for retention therein. Tip 21 of pin 20 protrudes into the inner space or recess 8 of the needle-carrier 4. When the unit consisting of needlestrip 1 and bracket 9 is inserted into recess 8 of the needle-carrier (in the direction indicated by reference numeral 31), each slot 16 receives protuberance or projection formed by the tip 21. The tip 21 moves along the slot until it finally reaches the end-segment 18, thereby creating a secure mechanical and releasable interconnection between the bracket 9 and the needle-carrier 4. the needle-carrier 4 is thereby interconnected to the needlestrip 1 by means of the bracket 9.

Figure 2:
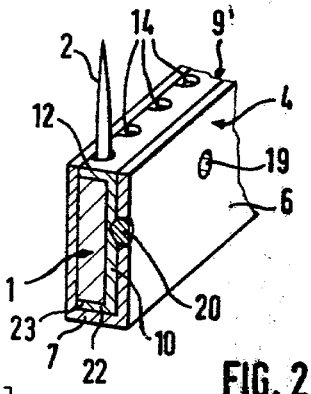
FIG. 2 is a fragmentary perspective view of a modified needlestrip assembly and needle-carrier in assembled relation.
Figure 3:
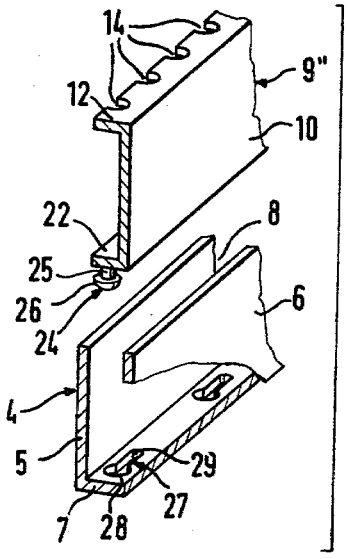
FIG. 3 is a view similar to that of FIG. 1 showing another embodiment.

In the embodiment of FIG. 2, the bracket 9' is provided with an additional leg 22 which underlies the base 23 of the needlestrip 1. The bracket 9' is thus channel-shaped and needlestrip 1 is accepted by the recess in the channel-shaped bracket defined by leg 10 (which may not be considered a web member) and legs 12 and 22. In FIG. 3, the leg 22 of the bracket 9" is shown as having depending locking pins 24 comprising an enlarged head 26 and a relatively smaller diameter stem 25. Apertures 27 are formed in crossbar 7 of the needle-carrier 4. Such apertures 27 include an enlarged opening 28 for reception of the head 26 and a relatively narrower slit 29 to permit movement of the stem 25 therein. When the bracket 9" is inserted in the needle-carrier 4, the head 26 of the locking pin 24 passes through enlargement 28 of aperture 27 until the protuberances 21 reach the upper extremity of slot-segment 17. At such time, and when the protuberances 21 are moved longitudinally within the end-segment 18 of the slots 16 of the bracket, the stem 25 of the locking pin 24 will slide within slit 29. Such shifting of the locking pin causes additional anchoring of the bracket 9" to the individual needlestrip 1 within the needle-carrier 4.

What I claim is:

1. Releasably interlockable needlestrip and needle-carrier for textile machines comprising a generally U-shaped elongated needle carrier having a pair of longitudinally extending spaced legs connected at one each of the corresponding ends thereof by a transverse bight section, said legs and bight section thereby defining a longitudinally extending recess therebetween, a plurality of protuberances provided on one of said legs projecting into said recess, an elongated needlestrip having opposed sidewalls and top and bottom faces, a bracket member having a least a pair of legs angularly connected relative to each other such that one of said legs is positionable in abutting relationship with one of the sidewalls of said needlestrip and the other of said legs is positionable in abutting relationship with the top face of said needlestrip, said needlestrip and bracket member when positioned in said abutting relationship being dimensioned and configured to fit snugly within the recess of said needle carrier, and a plurality of slots formed in the surface of said one leg of the bracket member remote from the sidewall of the needlestrip, each said slot having a first vertically extending segment and a second longitudinally extending segment, said protuberances and slots being so configured and arranged on said needle-carrier and bracket member that upon insertion of the needlestrip and abutting bracket member into the recess of said needle carrier said protuberances are alignable with the vertical segments of corresponding slots and are slidable therein for mechanical and releasable interlocking of the needlestrip, bracket member and needle-carrier.

2. Releasable interlockable needlestrip and needle-carrier according to claim 1, wherein a series of longitudinally-spaced needles are carried by said needlestrip and extend upwardly beyond the top face thereof.

3. Releasable interlockable needlestrip and needle-carrier according to claim 1, wherein said bracket member includes a third leg extending from the free end of said one leg in parallel relationship to said other leg, the spacing between said other leg and said third leg being adapted to snugly receive said needlestrip therebetween.

4. Releasable interlockable needlestrip and needle-carrier according to claim 3, wherein a series of longitudinally-spaced recesses are formed in said other leg of the bracket member, said recesses being dimensioned and spaced to permit the passage therethrough of needles carried by said needlestrip.

5. Releasable interlockable needlestrip and needle-carrier according to claim 4, wherein said recesses comprise apertures.

6. Releasable interlockable needlestrip and needle-carrier according to claim 3, wherein at least one depending locking pin is provided on said third leg of the bracket member and at least one corresponding aperture is formed in said bight section of the needle-carrier, said locking pin and aperture being so dimensioned and configured such that the locking pin is releasable locked within the corresponding aperture.

7. Releasable interlockable needlestrip and needle-carrier according to claim 6, wherein each said locking pin comprises an enlarged head portion and a stem of relatively smaller diameter, each said aperture comprising an enlarged opening dimensioned to receive the enlarged head of a locking pin and a relatively narrower slot communicating with said enlarged opening and extending longitudinally of the bight section.

8. Releasable interlockable needlestrip and needle-carrier according to claim 1, wherein a series of longitudinally-spaced recesses is formed in said other leg of the bracket member, said recesses being dimensioned and spaced to permit the passage therethrough of needles carried by said needlestrip.

9. Releasable interlockable needlestrip and needle-carrier according to claim 8, wherein said recesses comprise apertures.

10. Releasable interlockable needlestrip and needle-carrier according to claim 1, wherein said protuberances comprise pin members, each of said pin members being retained within a borehole formed in said one leg of said needle carrier, each said pin member having a tip portion which projects into the recess of said needle carrier for a distance sufficient to enter and slide within a corresponding one of said slots in said one leg of the bracket member.

* * * * *